United States Patent [19]

Houser

[11] 4,453,714

[45] Jun. 12, 1984

[54] BINGO GAME SUPPORT KIT

[76] Inventor: Bernard R. Houser, 1011 Isabella Dr., Stafford, Va. 22554

[21] Appl. No.: 414,058

[22] Filed: Sep. 2, 1982

[51] Int. Cl.[3] ..... A63F 3/06

[52] U.S. Cl. ..... 273/148 A

[58] Field of Search ..... 273/148.A, 150, 285; 40/124

[56] References Cited

U.S. PATENT DOCUMENTS

| | | | |
|---|---|---|---|
| D. 262,727 | 1/1982 | Snyder | 273/150 X |
| 1,308,010 | 6/1919 | Gibson | 248/460 |
| 1,508,082 | 9/1924 | Boeppler | 273/150 |
| 1,511,731 | 10/1924 | Kimmel | 273/150 |
| 1,682,486 | 8/1928 | Clark | 273/150 |
| 2,400,610 | 5/1946 | Skinner | 273/148 A X |
| 2,595,682 | 5/1952 | Lipa | 248/460 X |
| 2,722,425 | 11/1955 | Gazelle | 273/285 X |
| 3,381,928 | 5/1968 | White | 248/460 X |
| 3,895,806 | 7/1975 | Burns | 273/287 X |
| 4,291,882 | 9/1981 | Del Monte | 273/148 A |

FOREIGN PATENT DOCUMENTS

| | | | |
|---|---|---|---|
| 235347 | 6/1925 | United Kingdom | 248/260 |

*Primary Examiner*—Harland S. Skogquist

*Attorney, Agent, or Firm*—Kerkam, Stowell, Kondracki & Clarke

[57] ABSTRACT

A portable, foldable bingo card support device is disclosed which has a pair of elongated base members which are hinged together along a minor edge so that they can be folded with the bottom surfaces of the base members in abutment. Grooves are provided along the top surface of the base members which grooves run generally parallel to the major axes of the side edges. The grooves engage the bottom edges of a plurality of bingo cards while the back surfaces are engaged by a pair of card support members hinged to fold upon the grooved surfaces of the pair of base members. The assembly may also include a carrying handle and means for marking bingo card sheets.

3 Claims, 5 Drawing Figures

BINGO GAME SUPPORT KIT

TECHNICAL FIELD

This invention relates to a portable, foldable bingo game support kit that unfolds to support a plurality of bingo cards and or papers at at least two viewing elevations and releasable holds, bingo paper dabbers and a writing instument.

BACKGROUND OF THE PRIOR ART

Bingo players often play a plurality of bingo cards at once during the same game. Usually the cards are positioned on a relatively small area shared by other players, which often results in confusion which can lead to errors in play.

Devices are known which help to alleviate the problems arising from crowded conditions and poor lighting and which aid the players by supporting a number of bingo cards in an advantageous manner. One such prior art bingo card holding device is disclosed in U.S. Pat. No. 3,895,806 Burns.

Another plural card holder is disclosed in U.S. Pat. No. 4,291,882 Del Monte.

BRIEF SUMMARY OF THE INVENTION

It is a primary object of the present invention to provide a portable, foldable bingo card support kit which will permit the player to view a plurality of cards simultaneously, and such a device which is equipped with colored dabbers for use by the player on paper bingo sheets and a marking device for use during bingo games where the player selects his own numbers.

A further object of the present invention is to provide such a device that is readily foldable for ease of transportation to and from bingo parlors.

The invention may be generally defined as a portable, foldable bingo support kit which generally comprises a pair of elongate base members with each of the base members having top and bottom surfaces and major and minor side edges. Hinge means are provided to connect the two base members along a minor edge thereof whereby the pair of base members can be folded with the bottom surfaces in abutment. The assembly includes at least a pair of bingo card engaging grooves or the like in the top surface of the base members with the grooves running generally parallel to the major axis of the side edges. The support kit also includes a pair of elongate card support members, each of which has a length substantially equal to the length of the base members and having a width not greater than the width of the minor side edges of the base member. Hinge means connect the pair of card support members, one to each of the top surface of the base members and along one of the major side edges whereby the card support members can be folded to lie on the top surface of the base member to which it is hinged.

BRIEF DESCRIPTION OF THE DRAWINGS

The invention will be more particularly described in reference to the accompanying drawings wherein.

DETAILED DESCRIPTION OF THE INVENTION

Figure 1:
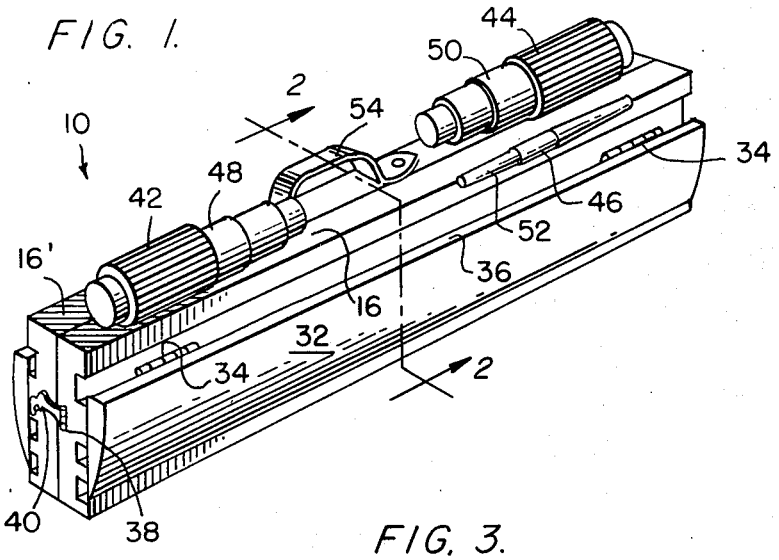
FIG. 1 is a perspective view of the Bingo Support Kit in its folded transportable position.

Referring to the drawings, 10 generally designates the improved portable, foldable bingo support kit. The device 10 includes a pair of base members 12 and 12'. The base members have a pair of side edges 14 and 16 and 14' and 16'. The side edges in the illustrated embodiment have a length of about 14 inches. The minor side edges 18 and 20 and 18' and 20' have widths of about 3.5 inches.

The pair of base members are hinged together by hinge means 22 such that when the bingo support kit is folded for transportation, the bottom surfaces 24 and 24' are in abutment.

The top surfaces 26 of each of the elongate base members are provided with at least a pair of grooves 28 and 30 and 28' and 30' which grooves are parallel to the longitudinal axis of the base members and extends substantially the length of each base member.

The groove 28—28' and 30—30' have sufficient depth to receive the bottom edge of bingo cards to be played.

Figure 2:
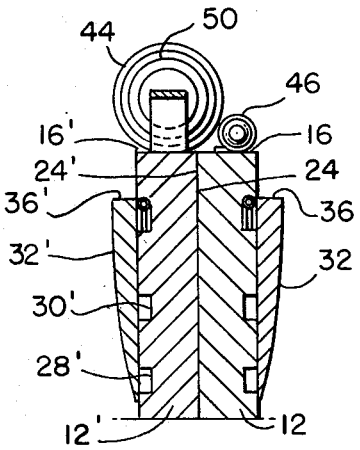
FIG. 2 is a section on line 2—2 of FIG. 1.
Figure 3:
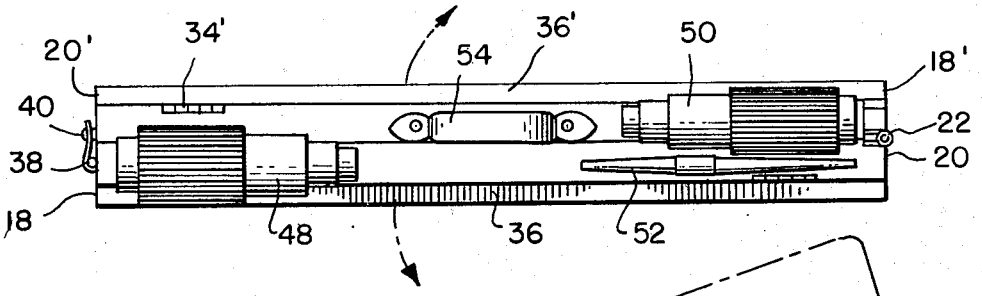
FIG. 3 is a top plan view of the structures shown in FIGS. 1 and 2.
Figure 4:
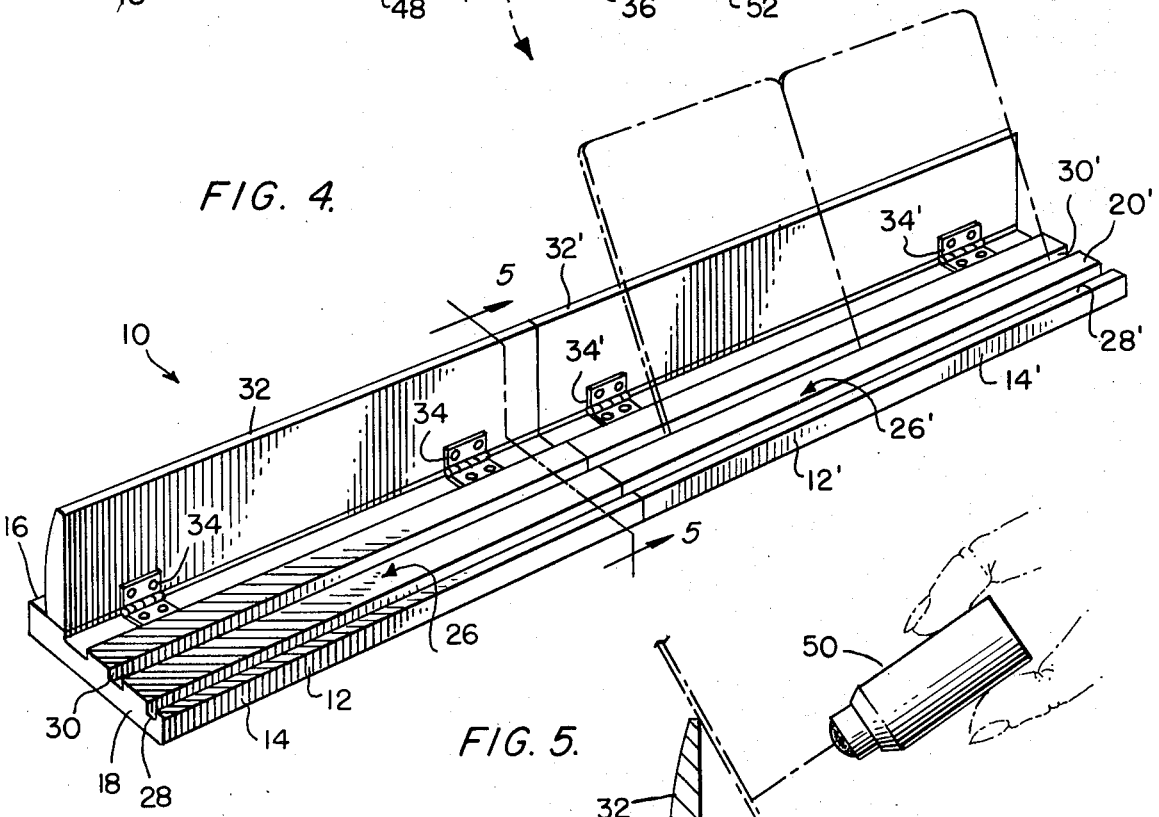
FIG. 4 is a perspective view of the Bingo Support Kit in its open operative position.

Each top surface 26—26' of the base members has hingedly mounted thereto a card support member 32 and 32'. The card support members 32—32' have lengths substantially equal to the length of the base members 26—26' and are hinged by hinge means 34 and 34' along the back edge 16 and 16' and parallel to the longitudinal axis of the base members. The card support members are so hinged that when they are in the upstanding position base edge 36—36' bears against the flat top surface 26—26' of their respective base members. Further, when the card support members 32—32' are in the folded position, as illustrated in FIGS. 1, 2 and 3, the width of the members is such that they do not project beyond the minor axis of the base members.

Figure 5:
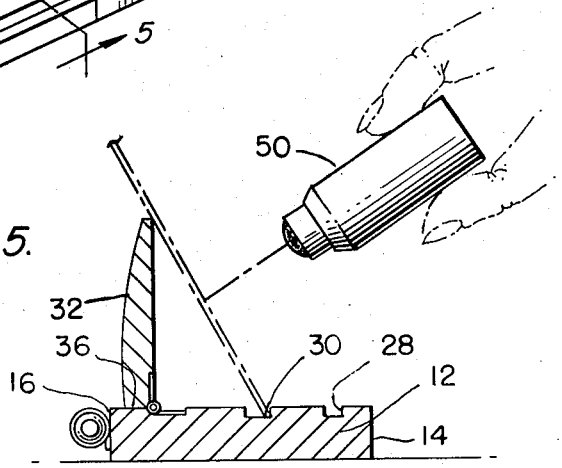
FIG. 5 is a section on line 5—5 of FIG. 4.

The assembly also includes releasable latch means 38 and 40 to retain the base members in their folded carrying position. As illustrated in FIGS. 1, 2 and 3, the back edges 16 and 16' of the bingo support kit include releasable holding means 42, 44 and 46 which in the illustrated form of the invention comprise elastic bands. Elastic bands 42 and 44 are sized to receive colored ink dabbers 48 and 50 which are used in playing bingo games wherein the game is printed on sheets of paper which are supported by the back surfaces of bingo cards as illustrated in FIG. 5.

The elastic band 46 receives a marking instrument such as a felt pen 52.

The assembly is completed by a carrying handle 54 mounted to back edge 16 of base member 26.

The base members and the card support members 26—26' and 32—32' may be constructed of wood, light metal, plastic or the like and it will be evident that the length of each of the base members and their associated card support members may range from about 14 to about 22 inches and be adapted to support as many as twelve bingo cards in two rows. It has been found that where the combined length of the base members is greater than about 42 inches, the card holders would have a tendency to encrouch on the playing zone of adjacent players. Further, it will be recognized by those skilled in the art that the elastic bands 42, 44 and 46 may be replaced by spring clips, Velcro or other holding devices.

I claim:

1. A portable, foldable bingo support kit comprising a pair of elongate base members, each said base member having top and bottom surfaces and major and minor side edges, means hinging said base members together along a minor edge thereof whereby the pair of base members can be folded with the said bottom surfaces in abutment, at least a pair of bingo card engaging grooves in the top surfaces of each of the base members with the grooves running parallel to the major side edges, a pair of elongate card support members, each of said card support members having a length substantially equal in length to said base members and having a width not greater than the width of the minor side edges of the base members, hinge means connecting the pair of card support members one to each said top of the base members and along one of the major said edges whereby the card support members can be folded to lie on the top surface of base member to which it is hinged.

2. The portable, foldable bingo support kit as defined in claim 1, further including releasable attaching means along the back major edge of said base members for releasably holding marking devices and a carrying handle secured along one of the back edges of one of the elongate base members.

3. The invention defined in claim 2, further including releasable latch means on each of the base members remote from the hinged edges thereof for releasably retaining said base members in the folded position.

* * * * *